US008333572B2

(12) United States Patent
Hsieh

(10) Patent No.: US 8,333,572 B2
(45) Date of Patent: Dec. 18, 2012

(54) PUMP

(75) Inventor: Huang Chin Hsieh, Taichung (TW)

(73) Assignee: Jongherya Co., Ltd., Taichung (TW)

( * ) Notice: Subject to any disclaimer, the term of this patent is extended or adjusted under 35 U.S.C. 154(b) by 276 days.

(21) Appl. No.: 12/830,454

(22) Filed: Jul. 6, 2010

(65) Prior Publication Data

US 2012/0009073 A1 Jan. 12, 2012

(51) Int. Cl.
*F04B 1/04* (2006.01)
*F04B 27/04* (2006.01)

(52) U.S. Cl. ..... 417/273; 417/271; 92/72

(58) Field of Classification Search ..... 417/273, 417/521, 269, 271; 91/491; 92/72
See application file for complete search history.

(56) References Cited

U.S. PATENT DOCUMENTS

| | | | | |
|---|---|---|---|---|
| 3,583,286 | A * | 6/1971 | Chiappulini | 91/491 |
| 5,839,349 | A * | 11/1998 | Volz | 92/147 |
| 6,450,787 | B1 * | 9/2002 | Risch et al. | 417/569 |
| 6,641,232 | B1 * | 11/2003 | Alaze | 417/536 |
| 6,732,631 | B1 * | 5/2004 | Bitzer et al. | 92/72 |
| 6,848,890 | B2 * | 2/2005 | Nakazawa | 417/410.1 |

* cited by examiner

*Primary Examiner* — Peter J Bertheaud

(57) ABSTRACT

A pump includes a cylindrical main body comprising a central channel, four valve assemblies each threadedly fastened in a radial hole, first and second cavities disposed to each hole and communicating therewith, a spring activated first check valve in each first cavity, a spring activated second check valve in each second cavity, an outlet, a threaded outlet orifice communicating with the outlet, an inlet, a threaded inlet orifice communicating with the inlet, four plungers each in a plunger chamber communicating between the hole and the channel, opposite outlet and inlet tunnels, two snapping members each having a central hole and a snapping bifurcation at either bent end, the snapping bifurcation slidably put on an end of the plunger; a top cover; a bottom cover; and an eccentric shaft having one end secured to motor shaft and other portions in the main body to operatively secure to the snapping members.

4 Claims, 9 Drawing Sheets

PUMP

BACKGROUND OF THE INVENTION

1. Field of Invention

The invention relates to pumps and more particularly to such a pump with improved characteristics.

2. Description of Related Art

Positive-displacement pumps for transporting fluids are known in the art. The pump comprises a periodic displacer, a piston or diaphragm, and two passive check valves. Due to the periodic movement of the piston or diaphragm, liquid is drawn into a pump chamber through an inlet valve and displaced from the pump chamber through an outlet valve. Due to the use of these valves, the conventional pumps are complicated and expensive. Moreover, the direction of transport is predetermined by the arrangement of the valves. When the pumping direction of such an arrangement is to be reversed, such pumps require a change of the operating direction of the valves from outside which entails a high expenditure.

Further, a type of pump having a small constructional size and delivering small pumped streams is referred to as micropumps. The invention described later is directed to a miniaturized pump with improved characteristics.

SUMMARY OF THE INVENTION

It is therefore one object of the invention to provide a pump comprising an electric motor having a driving shaft; a substantially cylindrical main body comprising a central channel, four spaced radial partially threaded holes, each hole having one end communicating with the channel and the other end open, four valve assemblies each threadedly fastened in the hole, first and second cavities, disposed to each hole and communicating therewith, a spring activated first check valve disposed in each of the first cavities, a spring activated second check valve disposed in each of the second cavities, an outlet disposed in the main body and having one end open, a partially threaded outlet orifice disposed in the main body to communicate with the outlet, the outlet orifice having one end open, an inlet disposed in the main body and having one end open, a partially threaded inlet orifice disposed in the main body to communicate with the inlet, the inlet orifice having one end open, four plungers each disposed in a plunger chamber communicating between the hole and the channel, opposite outlet and inlet tunnels, disposed in the main body, the outlet tunnel having one end communicating with the plunger chamber and the other end communicating with the first check valve via the hole, the inlet tunnel having one end communicating with the plunger chamber and the other end communicating with the second check valve via the hole, two snapping members each having a central hole and a snapping bifurcation at either bent end, the snapping bifurcation being slidably put on an inner end of the plunger, a plurality of first passages each communicating between the first cavity and the hole, and a plurality of second passages each communicating between the second cavity and the hole wherein one of the holes is disposed between the inlet orifice and the outlet orifice; a top cover disposed on the main body and comprising a central stepped diameter passageway, a first bearing disposed in the passageway, and an annular first groove spaced around the passageway on one surface facing and communicating with the outlet; a bottom cover disposed on the main body and comprising a bossed central hole, an annular second groove spaced around the hole on one surface facing and communicating with the inlet; and an eccentric shaft having one end secured to the driving shaft and disposed in the passageway to be supported by the bearing, the eccentric shaft further disposed in the channel and comprising an eccentric portion at the other end and passing the hole, a central protrusion projecting out of the other end to fit in a second bearing in the bottom cover, and a third bearing put on the eccentric portion to abut the eccentric shaft, wherein in response to activating the motor, the eccentric shaft rotates to move the plungers back and forth in the plunger chambers; wherein the second check valve is open when the plunger moves to increase a volume of the plunger chamber in an inward stroke, and fluid from the inlet orifice is drawn into the plunger chamber via the second groove, the open second check valve, and the inlet tunnel; wherein the first check valve is open when the plunger moves to decrease the volume of the plunger chamber in an outward stroke to pressurize the fluid, and the pressurized fluid is supplied from the plunger chamber to the outlet orifice via the outlet tunnel, the open first check valve, and the first groove; wherein vacuum is created in the plunger chamber in the inward stroke to close the first check valve so that the fluid is directed into the plunger chamber via the open second check valve; wherein the fluid flows into the plunger chamber from the inlet orifice via the second groove, the open second check valve, and the inlet tunnel in the inward stroke; and wherein pressure is built in the plunger chamber in the outward stroke to close the second check valve so that the pressurized fluid is directed to flow out of the open first check valve.

The above and other objects, features and advantages of the invention will become apparent from the following detailed description taken with the accompanying drawings.

DETAILED DESCRIPTION OF THE INVENTION

Figure 1:
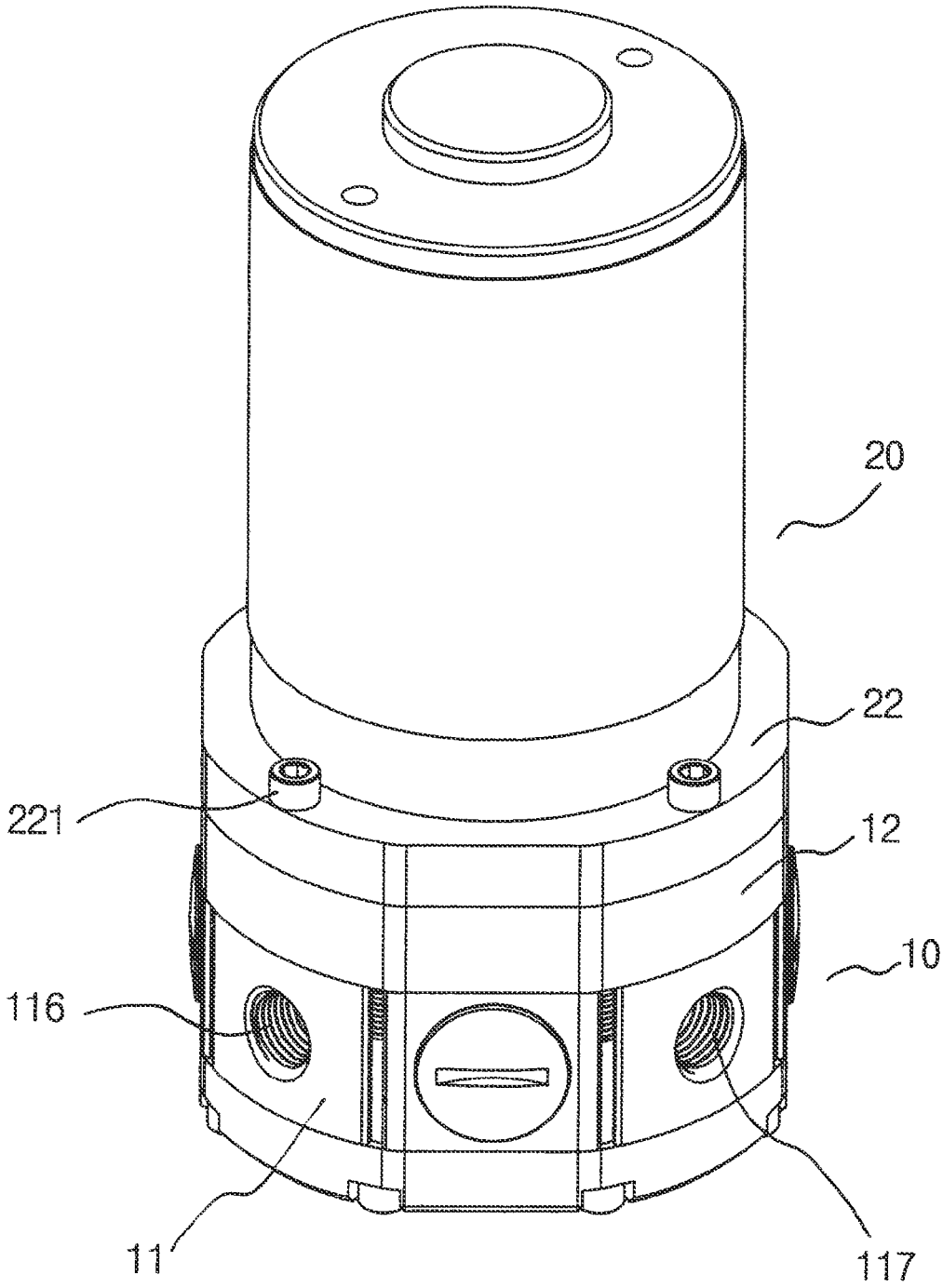
FIG. 1 is a perspective view of a pump according to the invention.
Figure 2:
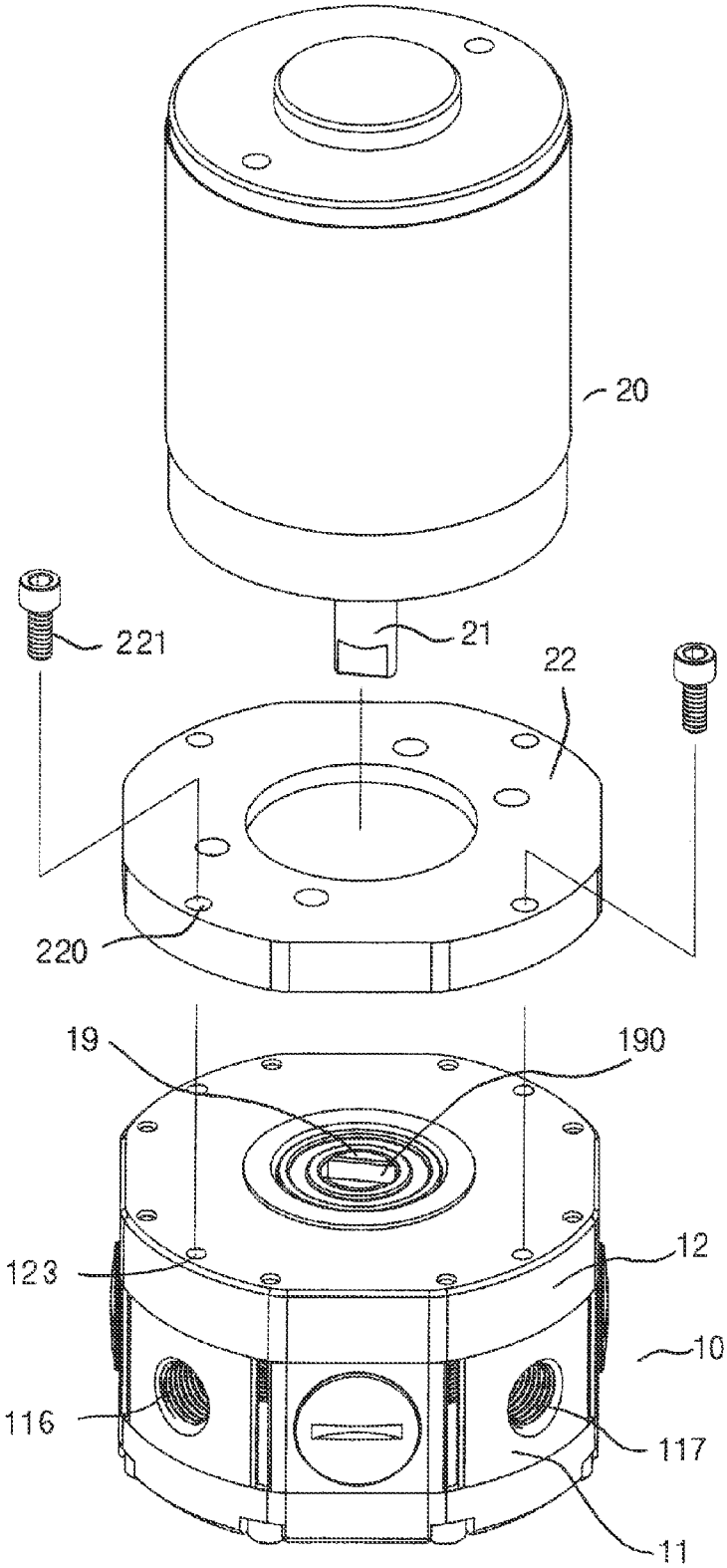
FIG. 2 is an exploded perspective view of the pump.

Referring to FIGS. 1 to 12, a pump in accordance with the invention comprises the following components as discussed in detail below.

A substantially eight-sided housing 10 comprises a main body 11, a top cover 12 provided on the main body 11, and a bottom cover 13 provided on the main body 11. The main body 11 comprises a central channel 110 and a plurality of (four) equally spaced radial partially threaded holes 111 arranged annually, each hole 111 having one end in communication with the channel 110 and the other end open to the periphery. A plurality of valve assemblies 14 each is fastened in the hole 111. An upper cavity 112 and a lower cavity 113 are provided to each hole 111 and in communication therewith. An upper check valve 15 is provided in the upper cavity 112 and a lower check valve 16 is provided in the lower cavity 113. An outlet 114 is provided in the main body 11 and has one end communicating with a partially threaded outlet orifice 116 and the other end open to the top of the main body 11. An inlet 115 is provided in the main body 11 and has one end communicating with a partially threaded inlet orifice 117 and the other end open to the bottom of the main body 11. The inlet orifice 117 is provided between two adjacent holes 111. A plunger 17 is provided in a plunger chamber 140 of each valve assembly 14. An outlet tunnel 141 and an opposite inlet tunnel 142 are provided in the main body 11. The outlet tunnel 141 has one end communicating with the plunger chamber 140 and the other end communicating with the upper check valve 15 via the hole 111. The inlet tunnel 142 has one end communicating with the plunger chamber 140 and the other end communicating with the lower check valve 16 via the hole 111. The plunger 17 has on end extending into the channel 110 to be fastened by one of two snapping members 18. In detail, the bent snapping member 18 has a central hole 180 and a snapping bifurcation 181 at either end. The snapping bifurcations 181 are retained and put on the ends of the opposite plungers 17.

The disc shaped top cover 12 comprises a central stepped diameter passageway 120, a bearing 121 provided in the passageway 120, and an annular groove 122 around the passageway 120 on one surface facing the main body 11. An eccentric shaft 19 is provided in both the passageway 120 and the bearing 121. The outlet 114 communicates with both the groove 122 and the upper cavity 112. The shaft 19 has one end 190 matingly secured to an open end of a driving shaft 21 of an electric motor 20, an eccentric portion 191 at the other end and passing the hole 180, and a central protrusion 192 projecting out of the other end to fit in a bearing 131. A bearing 193 is put on the eccentric portion 191 to abut the shaft 19. The bottom cover 13 further comprises a bossed central hole 130 and an annular groove 132 around the hole 130 on one surface facing the main body 11. The inlet 115 communicates with both the groove 132 and the lower cavity 113.

A ring shaped bushing member 22 has a plurality of holes 220 along edge, and a plurality of screws 221 driven through the holes 220 into a plurality of threaded holes 123 of the top cover 12. As a result, the bushing member 22 is mounted between the motor 20 and the top cover 12. An outlet line (not shown) is threaded connected to the outlet orifice 116 and an inlet line (not shown) is threaded connected to the inlet orifice 117.

An activation of the motor 20 will rotate the eccentric shaft 19 via the driving shaft 21. Thus, the eccentric portion 191 of the eccentric shaft 19 cyclically pushes the plungers 17. As such, each plunger 17 moves back and forth in the plunger chamber 140 (i.e., reciprocally). Further, the lower check valve 16 is open when the plunger 17 moves out of the plunger chamber 140 (i.e., in inward stroke). Fluid from the inlet orifice 117 is drawn into the plunger chamber 140 via the open lower check valve 16 and the groove 132. To the contrary, the upper check valve 15 is open when the plunger 17 moves into the plunger chamber 140 (i.e., in outward stroke). The pressurized fluid is thus supplied from the plunger chamber 140 to the outlet orifice 116 via the open upper check valve 15 and the groove 122.

Figure 3:
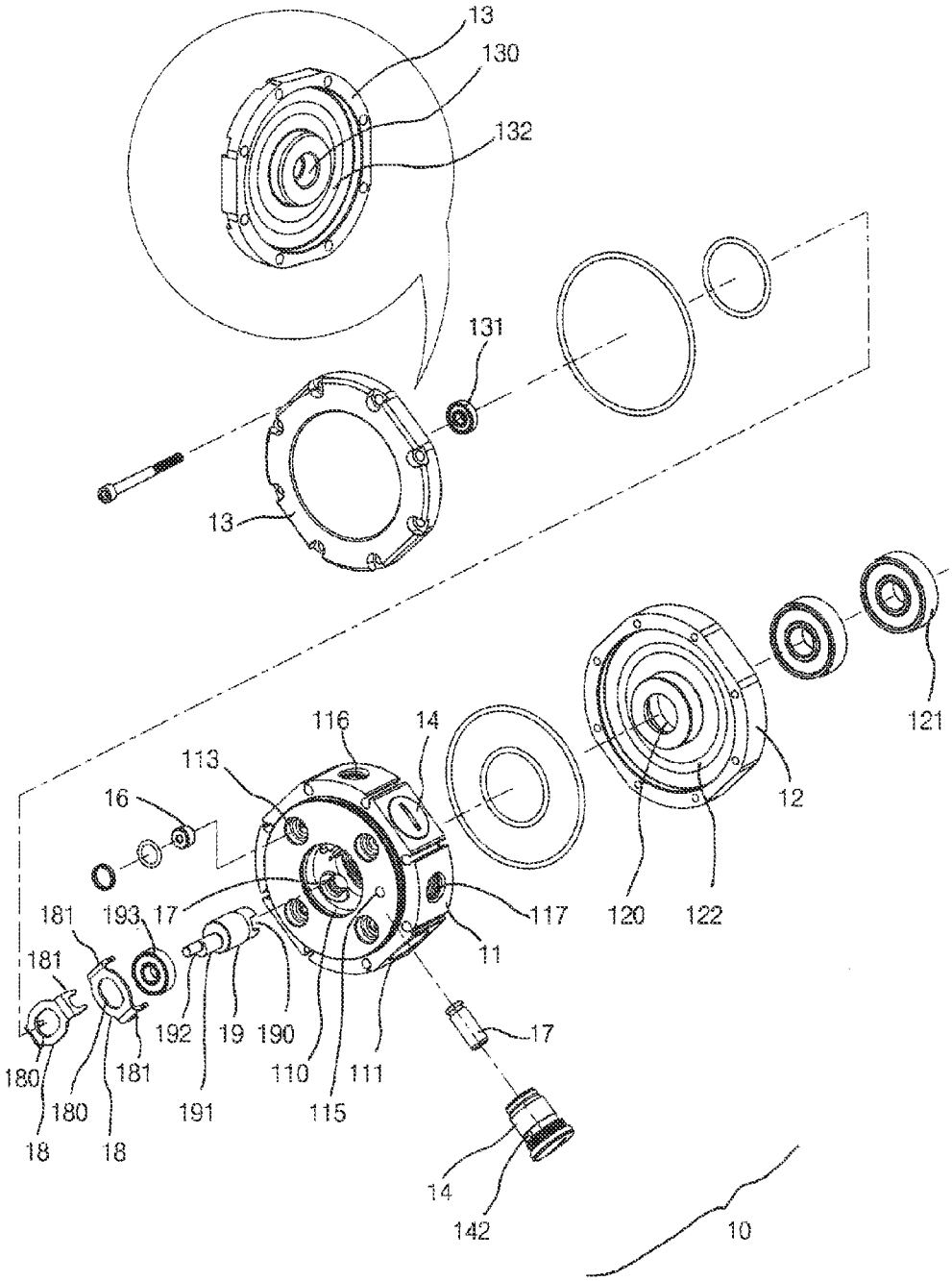
FIG. 3 is an exploded view of the components in the lower portion of the pump in FIG. 2.
Figure 4:
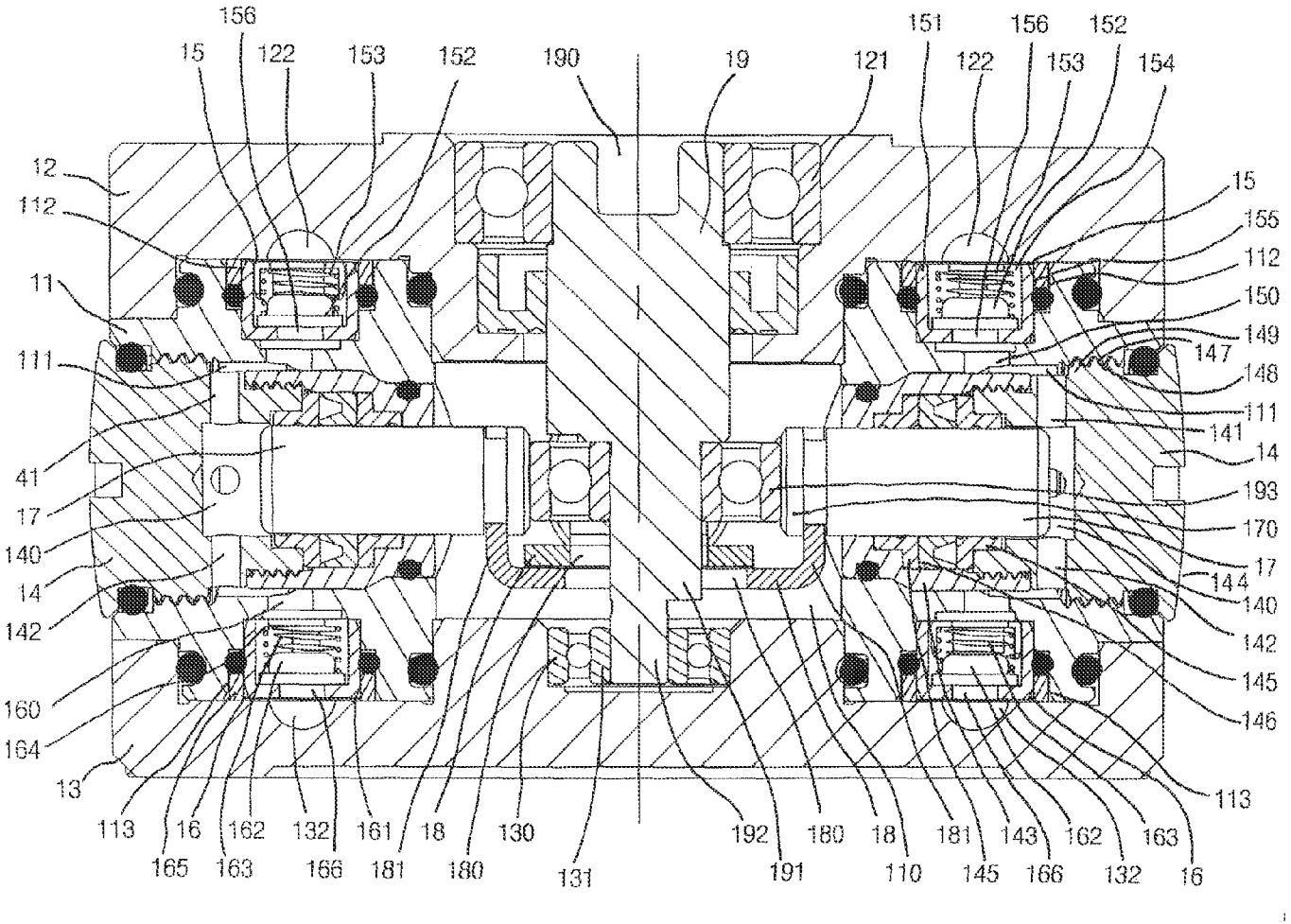
FIG. 4 is a longitudinal sectional view of the lower portion of the pump in FIG. 2.
Figure 5:
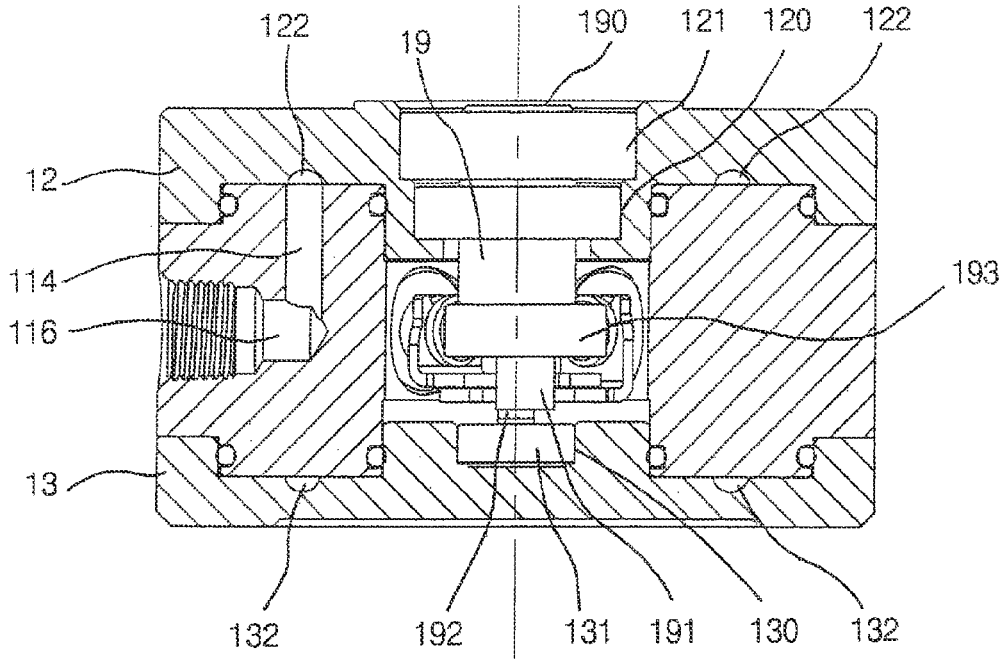
FIG. 5 is a simplified view of FIG. 4 showing details of the inlet arrangement.
Figure 6:
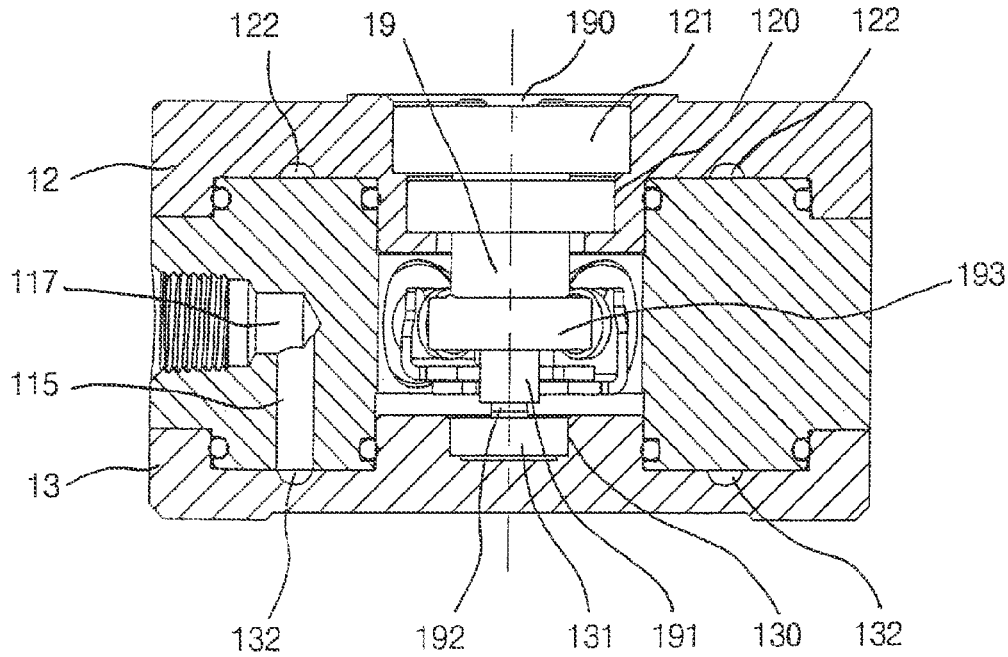
FIG. 6 is a simplified view of FIG. 4 showing details of the outlet arrangement.
Figure 7:
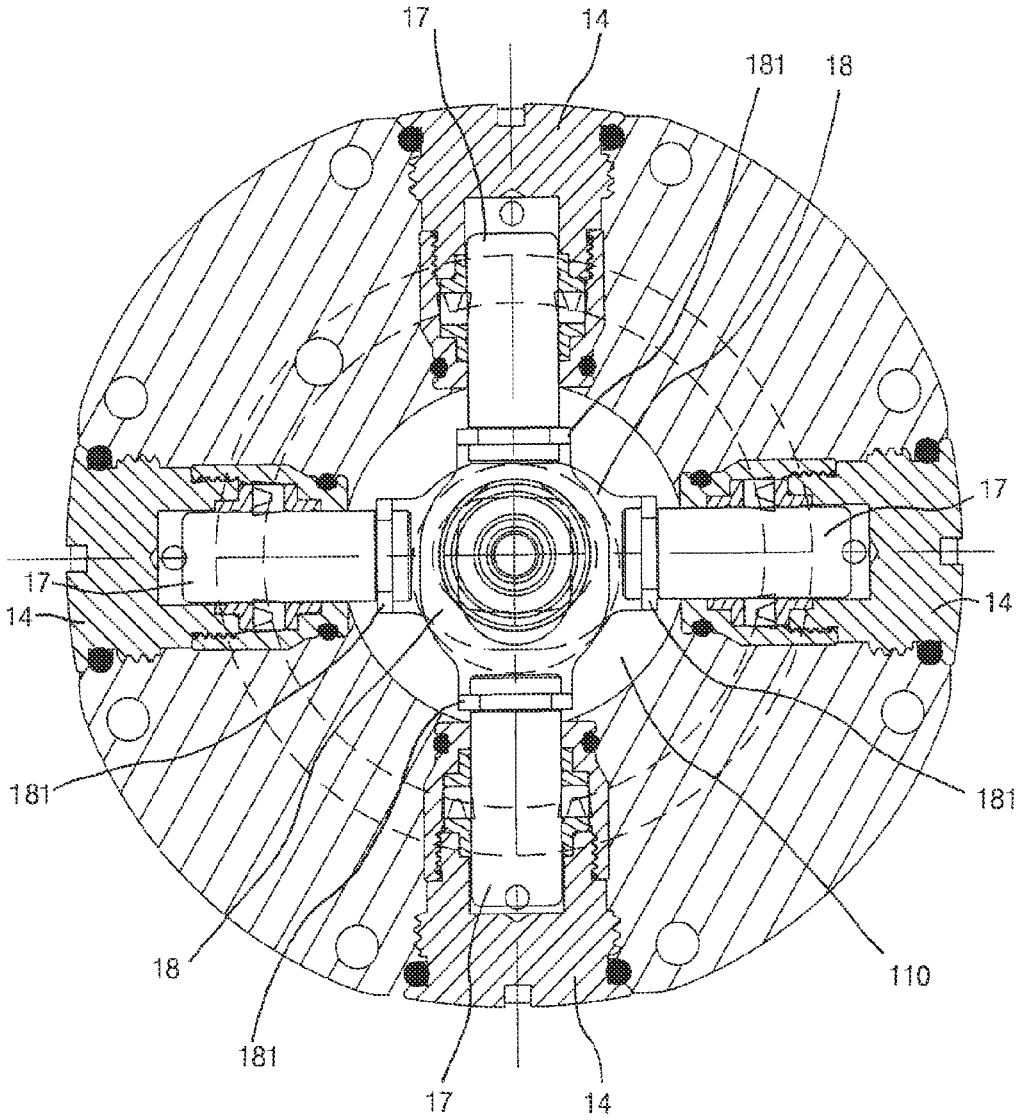
FIG. 7 is a cross-sectional view of the lower portion of the pump in FIG. 2.
Figure 8:
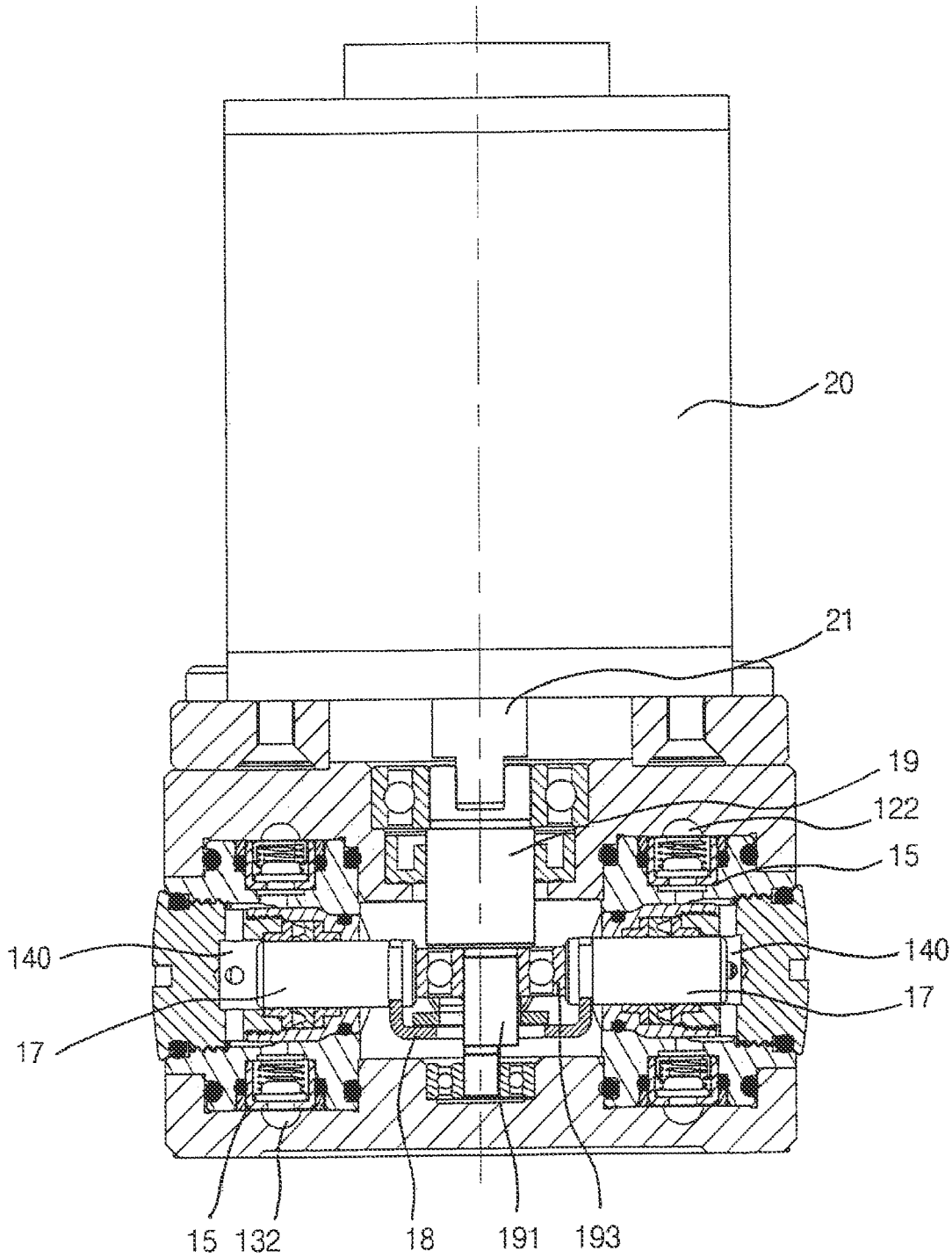
FIG. 8 is a reduced view of FIG. 4 with the motor mounted thereon, the motor activated and the eccentric portion of the eccentric shaft disposed to the right of a central axis.
Figure 9:
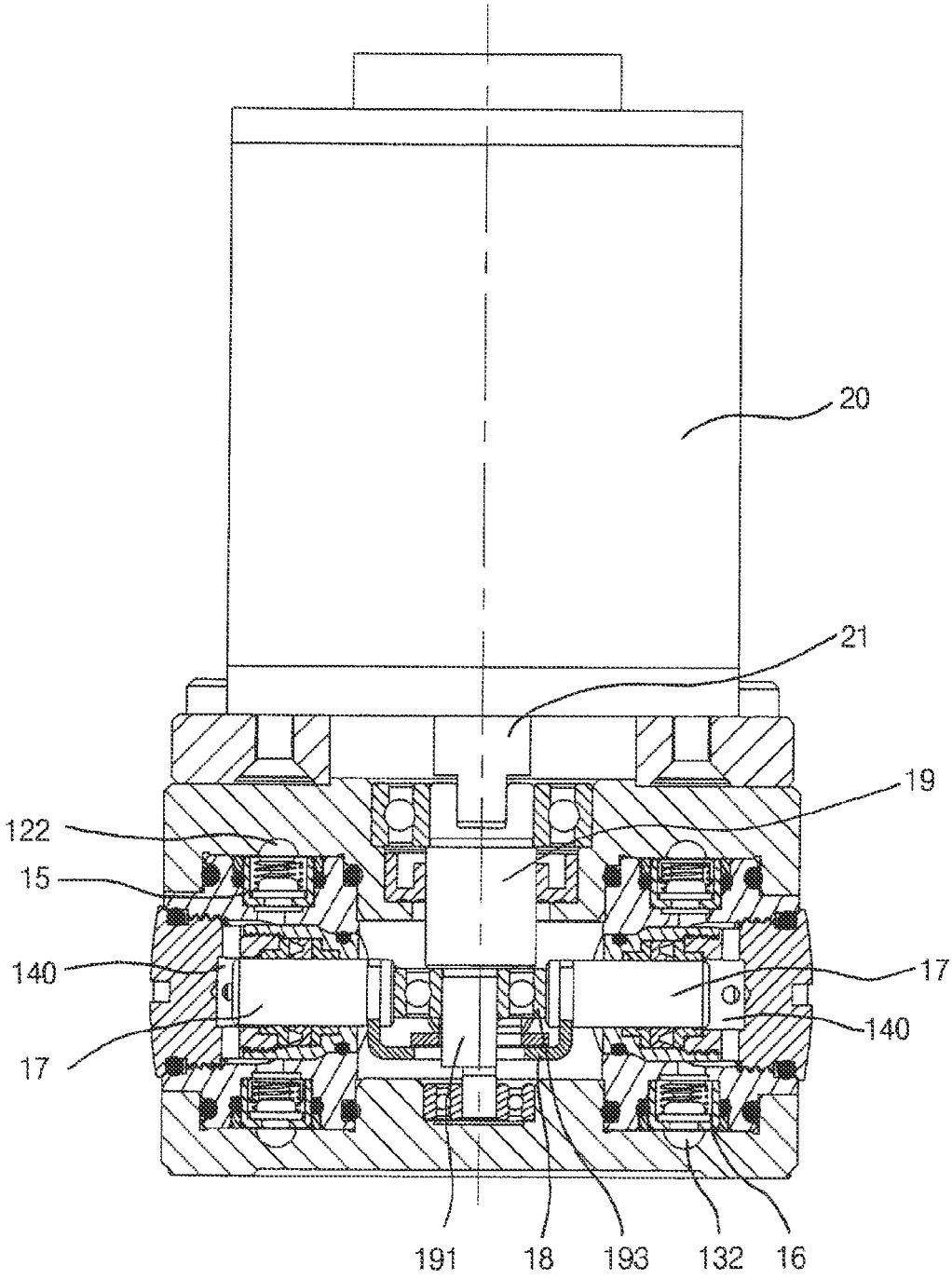
FIG. 9 is a view similar to FIG. 8 with the eccentric portion of the eccentric shaft disposed to the left of the central axis.
Figure 10:
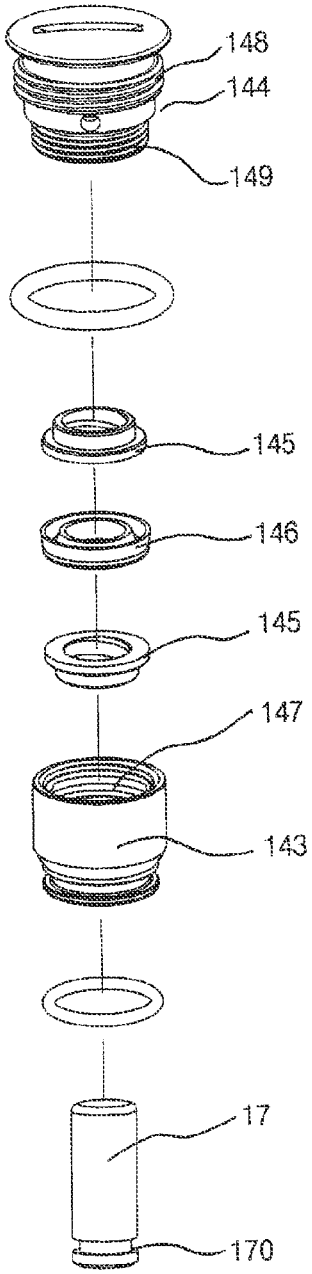
FIGS. 10, 11, and 12 are exploded view of the valve assembly, the upper check valve, and the lower check valve respectively.
Figure 11:
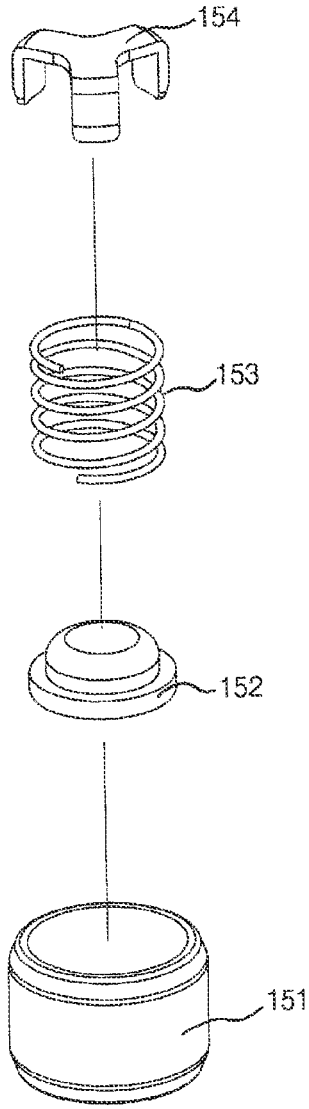
Figure 12:
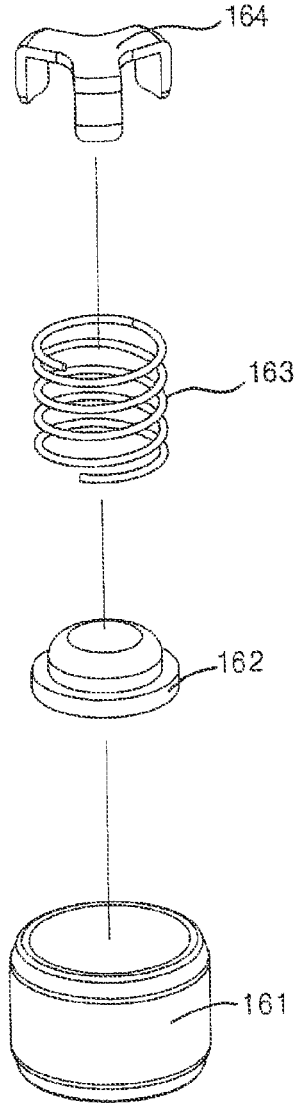

As shown in FIGS. 3, 4, and 10, the plunger 17 has an inner end 170 retained by the snapping bifurcation 181 of the snapping member 18. The cylindrical valve assembly 14 comprises, from inner end to outer end, a cylindrical receptacle 143 having bottom engaged with the outer end of the plunger 17 and internal threads 147, a plug 144 having first outer threads 149 secured to the threads 147 and second outer threads 148 secured to the hole 111, opposite outlet tunnel 141 and inlet tunnel 142 on the surface of the plunger chamber 140 in which the outlet tunnel 141 communicates with the upper check valve 15 and the inlet tunnel 142 communicates with the lower check valve 16, two spaced support rings 145 in the stepped diameter bore of the receptacle 143 for anchoring the plunger 17, and a sealing ring 146 put on the plunger 17 and clamped between the support rings 145.

In operations, the lower check valve 16 is open when the plunger 17 moves out of the plunger chamber 140 in inward stroke. Fluid from the inlet orifice 117 is drawn into the plunger chamber 140 via the groove 132, the open lower check valve 16, and the inlet tunnel 142. To the contrary, the upper check valve 15 is open when the plunger 17 moves into the plunger chamber 140 in outward stroke. The pressurized fluid is thus supplied from the plunger chamber 140 to the outlet orifice 116 via the outlet tunnel 141, the open upper check valve 15, and the groove 122.

An upper passage 150 communicates with the upper cavity 112 and the hole 111 at both ends. The upper check valve 15 comprises a cylindrical receptacle 151, an anchoring member 152 on the shoulder bottom, a helical spring 153 seated on the anchoring member 152, a three-legged fastening member 154 put on the spring 153, a sealing ring 155 provided in the upper cavity 112 for fastening the receptacle 151, and an opening 156 in the bottom of the receptacle 151 to be in communication with the upper passage 150. In an inoperative position, the opening 156 is closed by the anchoring member 152 due to the expansion of the spring 153. Moreover, the expansion of the spring 153 urges the fastening member 154 to sealingly engage with the groove 122.

In operations, the pressurized fluid is supplied from the plunger chamber 140 to the outlet orifice 116 via the outlet tunnel 141, the open upper check valve 15 (i.e., the upper passage 150, the opening 156, the anchoring member 152, and the receptacle 151), and the groove 122 in the outward stroke (i.e., volume of the plunger chamber 140 being decreased). To the contrary, a vacuum is created in the plunger chamber 140 in the inward stroke of the plunger 17. And in turn, the spring 153 pushes the anchoring member 152 to block the opening 156. Hence, the upper check valve 15 is closed. This ensures that fluid is prevented from flowing back to the plunger chamber 140 via the upper check valve 15. To the contrary, fluid flows into the plunger chamber 140 via the open lower check valve 16.

A lower passage 160 communicates with the lower cavity 113 and the hole 111 at both ends. The upper check valve 16 comprises a cylindrical receptacle 161, an anchoring member 162 on the shoulder bottom, a helical spring 163 seated on the anchoring member 162, a three-legged fastening member 164 put on the spring 163, a sealing ring 165 provided in the lower cavity 113 for fastening the receptacle 161, and an opening 166 in the bottom of the receptacle 161 to be in communication with the lower passage 160. In an inoperative position, the opening 166 is closed by the anchoring member 162 due to the expansion of the spring 163. The closure of the opening 166 also blocks the fluid communication with the groove 132.

In operations, fluid flows into the plunger chamber 140 from the inlet orifice 117 via the groove 132, the open lower check valve 16 (i.e., the lower passage 160, the opening 166, the anchoring member 162, and the receptacle 161), and the inlet tunnel 142 in the inward stroke (i.e., volume of the plunger chamber 140 being increased). To the contrary, a pressure is built in the plunger chamber 140 in the outward stroke of the plunger 17 (i.e., fluid is pressurized). And in turn, the spring 163 is pushed by the pressurized fluid in the plunger chamber 140 to urge the anchoring member 162 to block the opening 166. Hence, the lower check valve 16 is closed. This ensures that fluid is prevented from flowing back from the groove 132 to the plunger chamber 140 via the lower check valve 16. To the contrary, the pressurized fluid flows out of the open upper check valve 15.

While the invention has been described in terms of preferred embodiments, those skilled in the art will recognize that the invention can be practiced with modifications within the spirit and scope of the appended claims.

What is claimed is:

1. A pump comprising:

an electric motor (20) having a driving shaft (21);

a substantially cylindrical main body (11) comprising a central channel (110), four peripherally spaced partially threaded holes (111), each partially threaded hole (111) having one end communicating with the central channel (110) and the other end open, four valve assemblies (14) threadedly fastened in the partially threaded holes (111) respectively, first and second cavities (112, 113) disposed at each partially threaded hole (111) and communicating therewith, a spring activated first check valve (15) disposed in each of the first cavities (112), a spring activated second check valve (16) disposed in each of the second cavities (113), an outlet (114) disposed in the main body (11) and having one end open, a partially threaded outlet orifice (116) disposed in the main body (11) to communicate with the outlet (114), the outlet orifice (116) having one end open, an inlet (115) disposed in the main body (11) and having one end open, a partially threaded inlet orifice (117) disposed in the main body (11) to communicate with the inlet (115), the inlet orifice (117) having one end open, four plungers (17) each disposed in a plunger chamber (140) communicating between each partially threaded hole (111) and the central channel (110), opposite outlet and inlet tunnels (141, 142) disposed at each plunger chamber (140), the outlet tunnels (141) having one end communicating with the plunger chambers (140) and the other end communicating with the first check valves (15) via each partially threaded hole (111), the inlet tunnels (142) having one end communicating with the plunger chambers (140) and the other end communicating with the second check valves (16) via each partially threaded hole (111), two snapping members (18) each having a central hole (180) and a snapping bifurcation (181) at first and second bent ends thereof, each snapping bifurcation (181) being slidably put on an inner end of each plunger (17), a plurality of first passages (150) each communicating between the first cavities (112) and each partially threaded hole (111), and a plurality of second passages (160) each communicating between the second cavities (113) and each partially threaded hole (111), wherein one of the partially threaded holes (111) is disposed between the inlet orifice (117) and the outlet orifice (116);

a top cover (12) disposed on the main body (11) and comprising a central stepped diameter passageway (120), a first bearing (121) disposed in the central stepped diameter passageway (120), and an annular first groove (122) spaced around the central stepped diameter passageway (120) on one surface of the top cover facing and communicating with the outlet (114);

a bottom cover (13) disposed on the main body (11) and comprising a bossed central hole (130), an annular second groove (132) spaced around the bossed central hole (130) on one surface of the bottom cover facing and communicating with the inlet (115); and an eccentric shaft (19) having a first end (190) secured to the driving shaft (21) and disposed in the central stepped diameter passageway (120) to be supported by the first bearing (121), the eccentric shaft (19) further disposed in the central channel (110) and comprising an eccentric portion (191) at a second end thereof which passes through the central holes (180) of the snapping members (18), a central protrusion (192) projecting out of the second end of the eccentric shaft (19) to fit in a second bearing (131) in the bottom cover (13), and a third bearing (193) put on the eccentric portion (191) to abut the eccentric shaft (19), wherein in response to activating the motor (20), the eccentric shaft (19) rotates to move the plungers (17) back and forth in the plunger chambers (140);

wherein the second check valves (16) open when each plunger (17) moves to increase a volume of the plunger chambers (140) during an inward stroke, and fluid from the inlet orifice (117) is drawn into each plunger chamber (140) via the second groove (132), the open second check valves (16), and the inlet tunnels (142);

wherein the first check valves (15) open when each plunger (17) moves to decrease the volume of the plunger chambers (140) during an outward stroke to pressurize the fluid, and the pressurized fluid is supplied from each plunger chamber (140) to the outlet orifice (116) via the outlet tunnels (141), the open first check valves (15), and the first groove (122);

wherein a vacuum is created in the plunger chambers (140) during the inward stroke of each plunger (17) to close the first check valves (15) so that the fluid is directed into the plunger chambers (140) via the open second check valves (16); and wherein pressure is built in the plunger chambers (140) during the outward stroke of each plunger (17) to close the second check valves (16) so that the pressurized fluid is directed to flow out of the open first check valves (15).

2. The pump of claim 1, wherein each valve assembly (14) further comprises a cylindrical receptacle (143) having a bottom engaged with each plunger (17) and internal threads (147), a plug (144) having first outer threads (149) secured to the internal threads (147) of the cylindrical receptacle (143) and second outer threads (148) secured to each partially threaded hole (111), two spaced support rings (145) in the cylindrical receptacle (143) for anchoring each plunger (17), and a sealing ring (146) put on the each plunger (17) and clamped between the support rings (145).

3. The pump of claim 1, wherein each of the first check valves (15) comprises a cylindrical receptacle (151), a bottom anchoring member (152), a biasing member (153) seated on the bottom anchoring member (152), a three-legged fastening member (154) put on the biasing member (153), a sealing ring member (155) disposed in each of the first cavities (112) for fastening the cylindrical receptacle (151) therein, and an opening (156) in bottom of the cylindrical receptacle (151) to communicate with the first passages (150), and wherein, in an inoperative position, the opening (156) is closed by the bottom anchoring member (152) due to expansion of the biasing member (153).

4. The pump of claim 1, wherein each of the second check valves (16) comprises a cylindrical receptacle (161), a bottom anchoring member (162), a biasing member (163) seated on the bottom anchoring member (162), a three-legged fastening member (164) put on the biasing member (163), a sealing ring member (165) disposed in each of the second cavities (113) for fastening the cylindrical receptacle (161) therein, and a bottom opening (166) in the cylindrical receptacle (161) to communicate with the second passages (160), and wherein, in the inoperative position, the bottom opening (166) is closed by the bottom anchoring member (162) due to expansion of the biasing member (163).

* * * * *